US008402658B2

(12) United States Patent
Lee et al.

(10) Patent No.: US 8,402,658 B2
(45) Date of Patent: Mar. 26, 2013

(54) MANUFACTURING METHOD OF COMPRESSOR PULLEY

(75) Inventors: Heon Sang Lee, Daejeon (KR); Seok Je Jeong, Daejeon (KR); Gyeong Min Kim, Daejeon (KR); Jong Mok Kim, Daejeon (KR)

(73) Assignee: Halla Climate Control Corp., Daejeon (KR)

( * ) Notice: Subject to any disclaimer, the term of this patent is extended or adjusted under 35 U.S.C. 154(b) by 788 days.

(21) Appl. No.: 12/595,968

(22) PCT Filed: Apr. 1, 2008

(86) PCT No.: PCT/KR2008/001825

§ 371 (c)(1),
(2), (4) Date: Oct. 15, 2009

(87) PCT Pub. No.: WO2008/126996

PCT Pub. Date: Oct. 23, 2008

(65) Prior Publication Data

US 2010/0126019 A1 May 27, 2010

(30) Foreign Application Priority Data

Apr. 17, 2007 (KR) ..... 10-2007-0037644

(51) Int. Cl.
*B21H 1/04* (2006.01)

(52) U.S. Cl. ..... 29/892.3

(58) Field of Classification Search ..... 29/892.3
See application file for complete search history.

(56) References Cited

U.S. PATENT DOCUMENTS

| | | | |
|---|---|---|---|
| 4,847,968 | A | 7/1989 | Shirai et al. |
| 5,904,060 | A | 5/1999 | Kanemitsu et al. |
| 2005/0217111 | A1 | 10/2005 | Yoshida et al. |

FOREIGN PATENT DOCUMENTS

| | | |
|---|---|---|
| DE | 2154739 | 5/1973 |
| DE | 102005014191 | 10/2005 |
| JP | 02-133136 | 5/1990 |
| JP | 2964048 | 8/1999 |
| JP | 2001-321871 | 11/2001 |
| JP | 2004-122157 | 4/2004 |

*Primary Examiner* — David Bryant
*Assistant Examiner* — Moshe Wilensky
(74) *Attorney, Agent, or Firm* — Lowe, Hauptman, Ham & Berner, LLP

(57) ABSTRACT

A compressor pulley having a partially cold forged base of improved strength and a bridge of improved strength is easily manufactured. Metal is heated to a predetermined temp and then hot forged into a pulley shape. A piercing step then forms a through hold in a center portion of the pulley. The heated pulley is then cooled to room temperature. Then the pulley is rough guided. A partial cold-forging step forges the base at room temperature. A slot is then pierced in the base portion. During a finishing step, groove working and grinding are performed on a surface of the pulley.

10 Claims, 7 Drawing Sheets

(a)

(b)

PRIOR ART (b)

Prior Art

MANUFACTURING METHOD OF COMPRESSOR PULLEY

RELATED APPLICATIONS

The present application is based on, and claims priority from, KR Application Number 10-2007-0037644, filed Apr. 17, 2007, and PCT Application Number PCT/KR08/001825, filed Apr. 1, 2008, the disclosures of which are hereby incorporated by reference herein in their entireties.

TECHNICAL FIELD

The present invention relates to a manufacturing method of a compressor pulley, and more particularly, to a manufacturing method of a compressor pulley, in which a base portion is partially cold-forged after a hot-forging process, whereby it is possible to facilely manufacture the compressor pulley and also improve strength of a bridge portion as well as the base portion.

BACKGROUND ART

Generally, a vehicle compressor is applied to an air conditioning system so as to be driven by power received from an engine and functions to compress refrigerant having a lower pressure by an evaporator into high temperature and high pressure gaseous refrigerant and then transfer the high temperature and pressure gaseous refrigerant to a condenser.

The compressor receives the power through a pulley connected via a belt to a crankshaft. As shown in FIG. 1, the pulley includes a circular plate-shaped base portion 111 that is disposed perpendicularly to a length direction of a compressor 120, and internal ring portion 114 and external ring portion 116 which are respectively protruded from the base portion 111 in the length direction of the compressor 120. A belt (not shown) connected with a crankshaft of an engine is hanged on an outer surface of the external ring portion 116 so as to be rotated. Rotational force of the belt is transmitted to a shaft fixed to an end of an inner surface of the internal ring portion 114, and thus the compressor 120 performs a compressing process.

The pulley 110 having the above-mentioned function is typically made of a metallic material so as to be capable of enduring tensile force of the belt, and the metallic material for the pulley 110 is worked by a hot forging method which provides a lower strength compared to a cold forging method but a lower manufacturing cost.

FIG. 2 is a flow chart showing manufacturing processes of a conventional compressor pulley. In order to manufacture the pulley 110, first of all, the metallic material is prepared, cut into a desired size and then heated to a temperature of about 1,000~1,250° C. through a heating process. The heated metallic material is formed into a pulley shape having the base portion 111, the internal ring portion 114 and the external ring portion 116 by a hot forging process. At this time, the metallic material is forged under a pressure of about 800~1,300 tons applied by a press, and the forging process may be repeated one or more times according to the metallic material, the temperature, the expected shape of the pulley and the pressure of the press.

A center portion of the pulley 110 treated by the hot forging process is also pierced so as to form a through-hole 115 through which one end of the shaft is inserted in the internal ring portion 114, and then cooled to a room temperature by a cooling process. The cooled pulley 110 secures a dimension and a thickness for a slot piercing process while being treated in a rough grinding step. The pulley 110 treated in the rough grinding step has a slot 112 formed at the base portion 111 by the slot piercing process, and thus only a bridge portion 113 is remained. The pulley 110 treated by the slot piercing process is completed through a finishing step in which groove working and grinding are performed on a surface thereof.

The pulley 110 completed by the above-mentioned processes is connected with the shaft of the compressor 120 and rotates. As described above, since the pulley 110 is manufactured by the hot forging process in which a metallic material is hot-forged, it is facile to manufacture the pulley 110. However, since the strength of the bridge portion 113 on which a physical force is concentrated is insufficient, it is apprehended that the bridge portion 113 may be easily damaged.

To solve such the problem and improve the strength of the bridge portion 113, the cold forging process that the metallic material is forged at a room temperature is used to manufacture the pulley 110, instead of the hot forging process that the metallic material is hot forged, so as to improve the strength of the bridge portion 113. By the cold forging process, the strength of the bridge portion 113 is improved. However, since the strength of the other portions except the bridge portion 113 are also improved, it is difficult not only to perform the central piercing process for forming the through-hole 115 at the central portion of the base portion 111 and the slot piercing process for forming the slot 112 at the base portion 111, but also to form the groove portion 117 at the outer surface of the external ring portion 116, and also there are other problems that damage of a work tip used for forming the groove portion may be increased and it is difficult to ensure accuracy of the groove portion 17 upon semi-roll forming process. In addition, the hot forging process can be performed at a press pressure of about 800~1,300 tons, but the cold forging process needs a press pressure of about 2,500 tons or more. Thus, there is another problem that a large-sized equipment for the cold forging process is required.

Further, as shown in FIG. 3, in the hot forging process that the heated metallic material is forged, a connecting portion 118 for connecting a center portion of the internal ring portion 114 is formed at a lower side of the internal ring portion 114 by a backward extruding process. Due to the connecting portion 118, serious inhomogeneous deformation and excessive barreling are occurred in a grain flow line formed around the bridge portion 113 comparing with a grain flow lines formed at other portions, and thus it becomes weak for stress and thus the strength thereof is lowered.

DISCLOSURE

Technical Problem

An object of the present invention to provide a manufacturing method of a compressor pulley, in which a base portion is partially cold-forged after a hot forging process, thereby increasing strength of the base portion, particularly remarkably increasing strength of a bridge portion.

Another object of the present invention to provide a manufacturing method of a compressor pulley, in which a connecting portion is formed to be extended to an upper side of an internal ring portion by a forward extruding process, thereby securing a grain flow line without barreling and increasing durability of the bridge portion and thus obtaining a high quality of compressor pulley with a low cost, which can be replaced with the pulley manufactured by the cold forging process.

Technical Solution

To achieve the above objects, the present invention provides a manufacturing method of a compressor pulley which comprises a circular plate-shaped base portion, and internal ring portion and external ring portion that are integrally formed with the base portion and protruded in a length direction of the compressor, comprising a heating step S1 which heats a metallic material to a predetermined temperature or more; a hot-forging step S2 which forges the metallic material into a pulley shape having the base portion, the internal ring portion and the external ring portion at a high temperature; a center portion piercing step S3 which forms a through-hole at a connecting portion so as to connect an inner surface of the internal ring portion; a cooling step S4 which cools the heated pulley to a room temperature; a rough grinding step S5 which processes inner and outer surfaces of the cooled pulley; a partially cold-forging step S6 which forges the base portion of the pulley at a room temperature; a slot piercing step S7 which forms a slot at the base portion; and a finishing step S8 in which groove working and grinding are performed on a surface of the pulley.

Preferably, a thickness h2 of the base portion is formed to be larger than a standard thickness h1 through the rough grinding step S5.

Further, the connecting portion is formed to be extended to an upper side of the internal ring portion through the hot-forging step S2.

Advantageous Effects

According to a manufacturing method of a compressor pulley of the present invention, since the cold forging process is performed at the hot forging process, the strength of the base portion is remarkably improved, particularly, the strength of the bridge portion on which physical force is concentrated is remarkably increased.

Further, since the connecting portion for connecting the center portion of the internal ring portion is formed to be extended to the upper side of the internal ring portion, the inhomogeneous deformation of the flow line formed in the pulley is lowered and thus the durability of the pulley is increased.

DESCRIPTION OF DRAWINGS

The above and other objects, features and advantages of the present invention will become apparent from the following description of preferred embodiments given in conjunction with the accompanying drawings, in which.

BEST MODE

Hereinafter, the embodiments of the present invention will be described in detail with reference to accompanying drawings.

Figure 1:
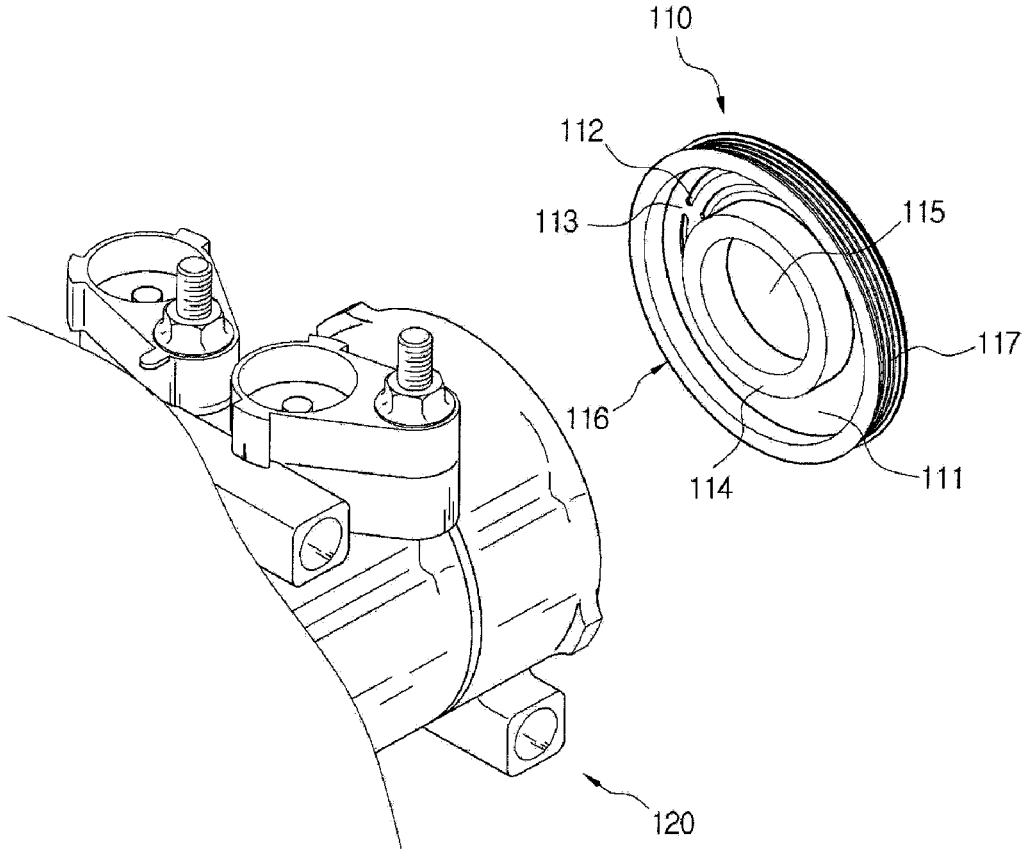
FIG. 1 is a perspective view of a conventional compressor pulley.
Figure 2:
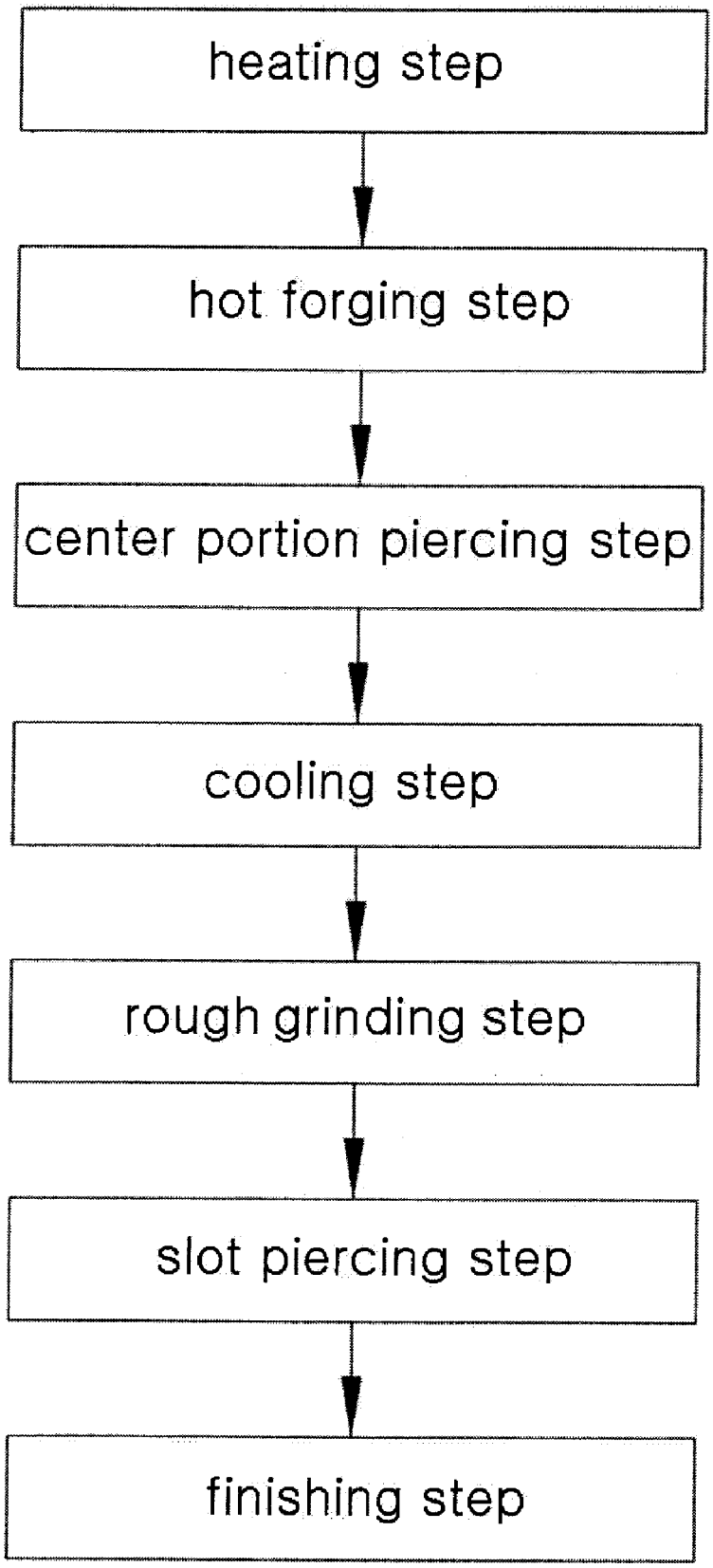
Figure 2 PRIOR ART
FIG. 2 is a flow charge showing a conventional manufacturing method of a compressor pulley.
Figure 3:
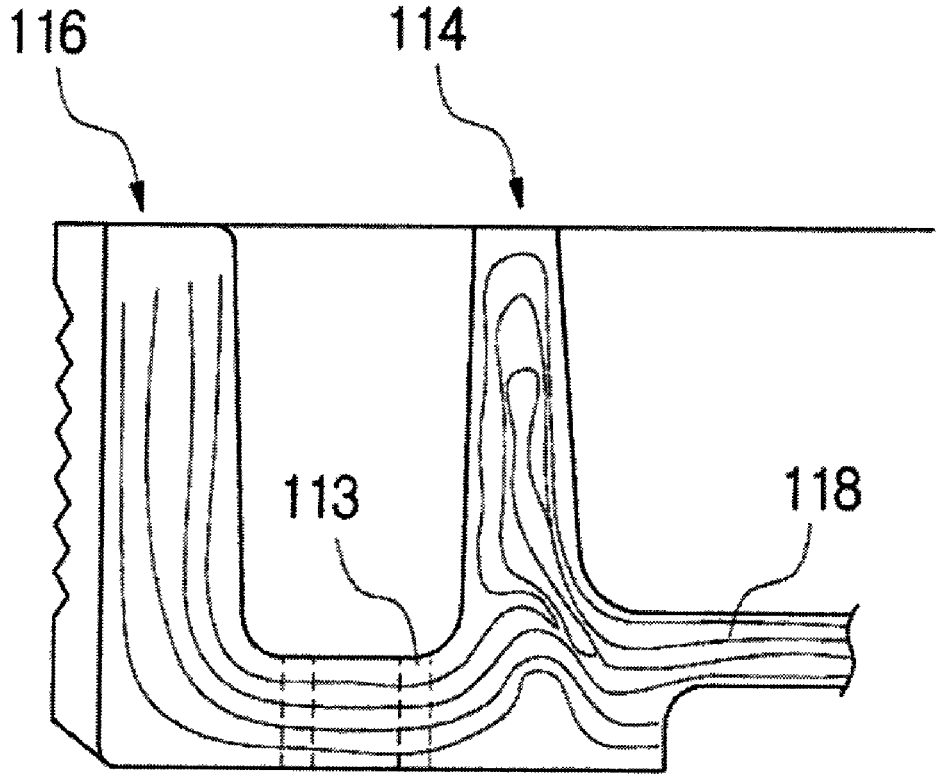
FIG. 3 is a cross-sectional view of a flow line of the conventional compressor pulley.
Figure 4:
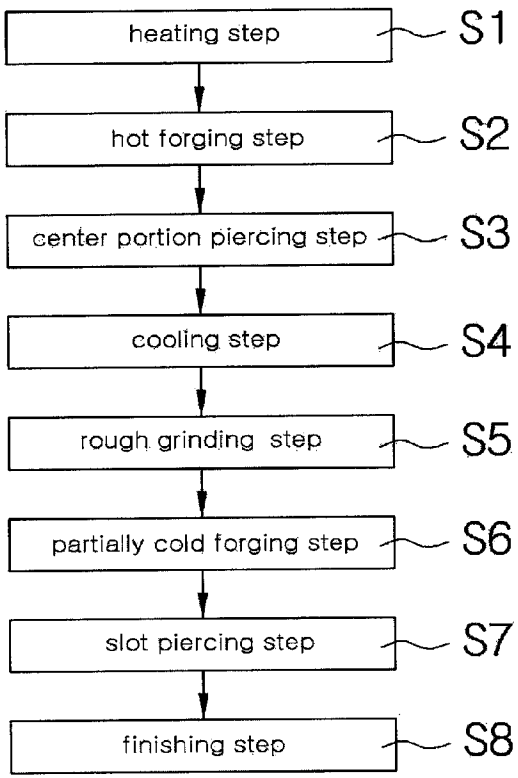
FIG. 4*a* is a perspective view of a compressor pulley according to the present invention.
FIG. 4*b* is a flow charge showing a manufacturing method of a compressor pulley according to the present invention.
Figure 4:
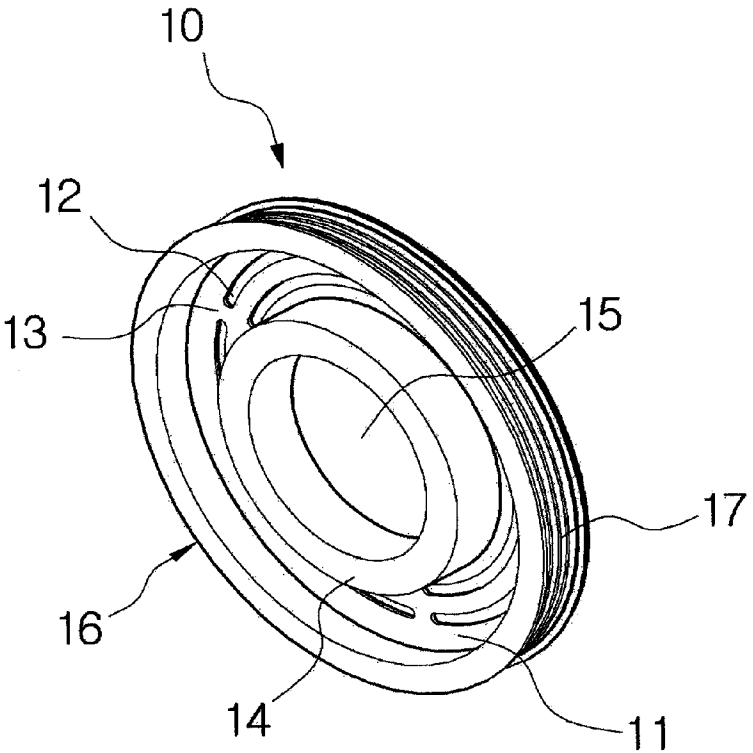

FIG. 4*a* is a perspective view of a compressor pulley according to the present invention, and FIG. 4*b* is a flow charge showing a manufacturing method of a compressor pulley according to the present invention. The manufacturing method of a compressor pulley according to the present invention includes a heating step S1, a hot forging step S2, a center portion piercing step S3, a cooling step S4, a rough grinding step S5, a partially cold-forging step S6, a slot piercing step S7 and a finishing step S8.

Referring to FIGS. 4*a* and 4*b*, the manufacturing steps of the pulley will be described in detail. A metallic material prepared for manufacturing the pulley 10 is, cut into a desired size to the needs and then heated to a temperature of 1,150° C. or more in the heating step S1. The metallic material heated to temperature of 1,150° C. or more through the heating step S1 is hot-forged into the shape of pulley 10 by a press in the hot forging process S2 so as to have a base portion 11, an internal ring portion 14 and an external ring portion 16. In the hot forging process S2, the metallic material is forged at a pressure of about 800~1,300 tons, and the number of the forging processes is determined according to an expected shape of the pulley 10 and the pressure of the press.

Figure 5:
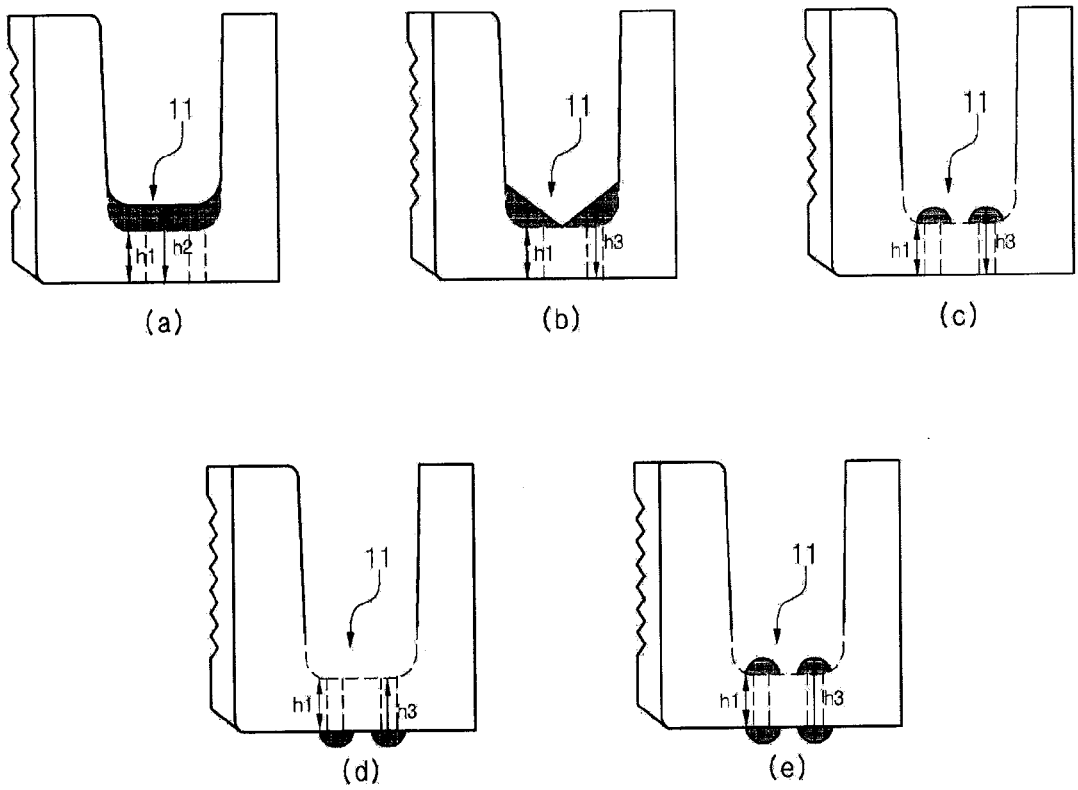
FIG. 5 is cross-sectional view of the pulley in a rough grinding step.

A center portion of the pulley 10 treated through the hot forging process S2 is pierced in the center portion piercing step S3 so as to form a through-hole 15 through which one end of a shaft is inserted into the internal ring portion 14, and then cooled to a room temperature in the cooling step S4. Inner and outer surfaces of the cooled pulley 10 is worked with a roughness of 1 μmRa or more in the rough grinding step S5. In the rough grinding step S5, the inner and outer surfaces of the pulley 10 are worked to have nearly completed shape. Then, in the next partially cold-forging step S6, it is preferred that the pulley 10 is worked so that a thickness h2 of the base portion 11 is larger than a standard thickness h1 of the base portion 11 of the completed pulley 10, as shown in FIG. 5*a*.

In the rough grinding step S5, more preferably, a thickness h3 of the bridge portion 13 is larger than the standard thickness h1 of the base portion 11 of the completed pulley 10 as shown in FIGS. 5*b* to 5*e*. As described above, since only the thickness h3 of the bridge portion 13 is formed to be thick selectively, the process can be performed with a small pressure.

After the rough grinding step S5, only the base portion of the pulley 10 is selectively forged through the partially cold-forging step S6 and a slot 12 is formed at the base portion 11 in the slot piercing step S7. Thus, only the bridge portion 13 is remained. Then, the pulley 10 is completed through a finishing step S7 in which groove working and grinding are performed on a surface thereof.

In the partially cold-forging step S6, since the forging process is performed with respect to only the base portion 11, the forging process can be performed with a small press pressure of about 600~800 tons, and thus it is possible to reduce the manufacturing cost.

Figure 6:
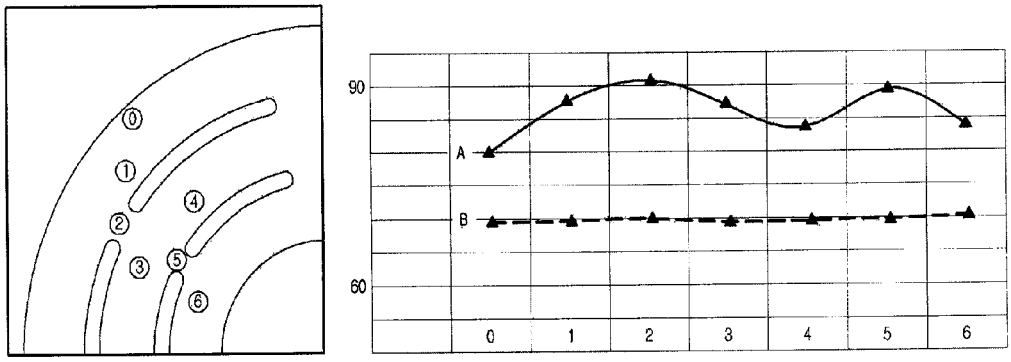
FIG. 6 is a graph showing strength of each portion of the compressor pulley according to the present invention.

FIG. 6 is a graph showing hardness of each portion of the compressor pulley according to the present invention, wherein B in the FIG. 6 shows a hardness of the base portion that is manufactured by only the conventional hot-forging process, and A in the FIG. 6 shows a hardness of the base portion which is treated by the partially cold-forging process after the hot-forging step.

Referring to FIGS. 4*a* and 6, in case that the pulley 10 is manufacture through only the hot-forging process, each hardness of the bridge portion 13 (②⑤) and the base portion 11 (①③④⑥) that the physical force is concentrated is about 70 HRB or less. However, in case that the partially cold-forging process is performed with respect to only the base portion 11 after the hot-forging step, the hardness of the base portion 11 is increased over all comparing with the conventional pulley. It can be understood from the above fact that the base portion 11 manufactured through the hot-forging process may be facilely damaged due to limitation of the strength, but the base portion 11 manufactured through the partially cold-forging process after the hot-forging process has the improved strength (①③④⑥), particularly, the strength (②⑤) of the bridge portion 13 is remarkably increased, thereby improving stability of the pulley 10.

In the manufacturing of the pulley 10, as described above, since the metallic material is heated and then forged, it is facile to manufacture the pulley 10, and also since only the base portion 11 is partially forged at a room temperature, the strength of the bridge portion 13 on which the physical force is concentrated is increased.

Figure 7:
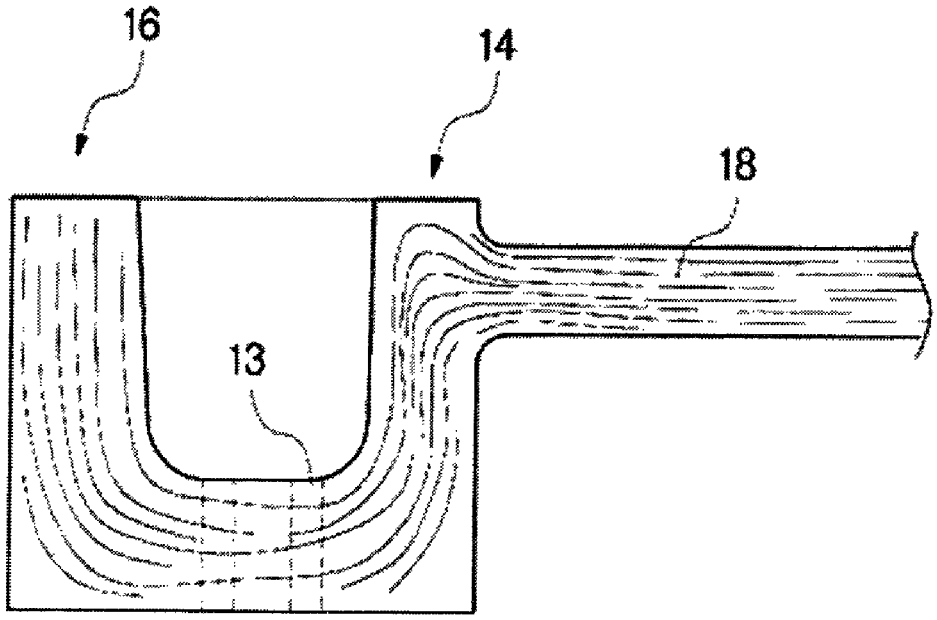
FIG. 7 is a cross-sectional view showing a grain flow line of the compressor pulley according to the present invention.

FIG. 7 shows grain flow lines of the compressor pulley according to the present invention. In the hot forging step S2 in which the heated metallic material is forged, the connecting portion 18 for connecting the center portion of the internal ring portion 14 is formed to be extended to the upper side of the internal ring portion 14. Therefore, the inhomogeneous deformation of the flow line formed in the pulley 10 is lowered. This means that defects in the pulley 10 are reduced and thus the durability of the pulley is increased.

As described above, it is preferred that the heated metallic material is worked through the forward extruding process so that the connecting portion 18 is formed to be extended to the upper side of the internal ring portion 14. Herein, the forward extruding process is a contrary concept to the backward extruding process, and the metallic material is deformed in the same direction as a moving direction of a punch by the forward extruding process. For example, the metallic material is put on a die having concave and convex portions, and then the pressing is applied from an opposite direction to the die.

Since the heated metallic material is treated by the forward extruding process so as to be extended to the upper side of the internal ring portion 14, defects in the pulley 10 are reduced, particularly, the defects in the bridge portion that the physical force is concentrated are reduced, and thus the durability of the pulley 10 is increased.

Those skilled in the art will appreciate that the conceptions and specific embodiments disclosed in the foregoing description may be readily utilized as a basis for modifying or designing other embodiments for carrying out the same purposes of the present invention. Those skilled in the art will also appreciate that such equivalent embodiments do not depart from the spirit and scope of the invention as set forth in the appended claims.

INDUSTRIAL APPLICABILITY

The present invention relates to a manufacturing method of a compressor pulley of the present invention, since the cold forging process is performed at the hot forging process, the strength of the base portion is selectively improved, particularly, the strength of the bridge portion on which physical force is concentrated is remarkably increased.

Further, since the connecting portion for connecting the center portion of the internal ring portion is formed to be extended to the upper side of the internal ring portion, the inhomogeneous deformation of the flow line formed in the pulley is lowered and thus the durability of the pulley is increased.

The invention claimed is:

1. A method of manufacturing a compressor pulley which comprises a plate-shaped base portion, and an internal ring portion and an external ring portion that are each integrally formed with the base portion and protrude in a length direction of the compressor pulley, said method comprising:

heating a metallic material to at least a predetermined temperature;

hot-forging the metallic material into a pulley shape having the base portion, the internal ring portion and the external ring portion;

piercing a center portion of the metallic material to form a through-hole at a connecting portion connecting with an inner surface of the internal ring portion;

cooling the heated metallic material to a room temperature;

grinding inner and outer surfaces of the cooled metallic material;

partially cold-forging the base portion at the room temperature;

forming slots at the base portion; and performing groove working and grinding on a surface of the pulley-shaped metallic material, wherein a thickness of a bridge portion that is formed between the slots after the grinding is larger than a standard thickness of the base portion, and the partial cold-forging is performed only on the bridge portion that has the thickness larger than the standard thickness of the base portion.

2. The method according to claim 1, further comprising forward extruding the metallic material to form the connecting portion that extends, in a direction substantially perpendicular to the length direction of the compressor pulley, on an upper side of the internal ring portion through the hot-forging.

3. The method according to claim 2, wherein said upper side of the internal ring portion is opposite to the bridge portion in the length direction of the compressor.

4. The method according to claim 1, wherein the predetermined temperature is higher than the room temperature.

5. The method according to claim 1, wherein the slots are spaced away from each other in a circumferential direction of the through hole, and the bridge portion is formed between slots that are adjacent to each other in the circumferential direction.

6. A method of manufacturing a compressor pulley which comprises a plate-shaped base portion, and an internal ring portion and an external ring portion that are each integrally formed with the base portion and protrude in a length direction of the compressor pulley, said method comprising:

heating a metallic material to a predetermined temperature;

hot-forging the metallic material into a pulley shape having the base portion, the internal ring portion and the external ring portion;

forming a through-hole at the metallic material at a connecting portion;

cooling the heated metallic material to a room temperature;

grinding inner and outer surfaces of the cooled metallic material;

partially cold-forging the base portion at the room temperature;

forming a slot at the base portion; and performing groove working and grinding on a surface of the pulley-shaped metallic material, wherein a thickness of the base portion after the grinding is larger than a standard thickness of the base portion, and the partial cold-forging is performed only on the base portion which has the thickness larger than the standard thickness of the base portion.

7. The method according to claim 6, further comprising forward extruding the metallic material to form the connecting portion that extends, in a direction substantially perpendicular to the length direction of the compressor pulley, on an upper side of the internal ring portion through the hot-forging.

8. The method according to claim 7, wherein said upper side of the internal ring portion is opposite to the bridge portion in the length direction of the compressor.

9. The method according to claim 6, wherein the predetermined temperature is higher than the room temperature.

10. The method according to claim 6, wherein the slots are spaced away from each other in a circumferential direction of the through hole, and the bridge portion is formed between slots that are adjacent to each other in the circumferential direction.

* * * * *